US009529308B2

(12) United States Patent
Ikebuchi et al.

(10) Patent No.: US 9,529,308 B2
(45) Date of Patent: Dec. 27, 2016

(54) IMAGE FORMING APPARATUS AND IMAGE FORMING METHOD

(71) Applicant: Ricoh Company, Ltd., Tokyo (JP)

(72) Inventors: Yutaka Ikebuchi, Kanagawa (JP); Yoshio Hattori, Kanagawa (JP); Ryuuichi Mimbu, Kanagawa (JP); Yasunori Ishigaya, Kanagawa (JP); Yoshiki Yamaguchi, Kanagawa (JP); Kazuya Saito, Kanagawa (JP); Toshihiko Shimokawa, Kanagawa (JP); Keitaro Shoji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/921,132

(22) Filed: Oct. 23, 2015

(65) Prior Publication Data

US 2016/0124359 A1 May 5, 2016

(30) Foreign Application Priority Data

Oct. 31, 2014 (JP) ..... 2014-222641

(51) Int. Cl.
*G03G 15/20* (2006.01)

(52) U.S. Cl.
CPC *G03G 15/2039* (2013.01); *G03G 2215/00599* (2013.01)

(58) Field of Classification Search
CPC ..... G03G 15/2039; G03G 15/205; G03G 15/2078; G03G 15/6555; G03G 15/657
See application file for complete search history.

(56) References Cited

U.S. PATENT DOCUMENTS

2008/0253789 A1 10/2008 Yoshinaga et al.
2009/0169232 A1 7/2009 Kunii et al.
2011/0052237 A1 3/2011 Yoshikawa et al.
2011/0064437 A1 3/2011 Yamashina et al.
(Continued)

FOREIGN PATENT DOCUMENTS

JP 61221774 A * 10/1986
JP 04331969 A * 11/1992
(Continued)

OTHER PUBLICATIONS

U.S. Appl. No. 14/806,558, filed Jul. 22, 2015.

*Primary Examiner* — Erika J Villaluna
(74) *Attorney, Agent, or Firm* — Duft Bornsen & Fettig LLP

(57) ABSTRACT

An image forming apparatus includes a fixing rotator and an opposed rotator pressed against the fixing rotator to form a fixing nip therebetween, through which a recording medium bearing a toner image is conveyed. A heater heats the fixing rotator. A temperature sensor contacts the opposed rotator to detect a temperature of the opposed rotator. A conveyor conveys the recording medium to the fixing nip. A driver drives the conveyor. A controller, operatively connected to the temperature sensor and the driver, controls the driver to drive the conveyor to convey the recording medium to the fixing nip based on the temperature of the opposed rotator detected by the temperature sensor. The controller causes the driver to be ready to drive the conveyor when a change in the detected temperature of the opposed rotator per unit time reaches a predetermined threshold.

17 Claims, 9 Drawing Sheets

(56) References Cited

U.S. PATENT DOCUMENTS

2011/0091226 A1 4/2011 Ishigaya et al.
2011/0129268 A1 6/2011 Ishii et al.
2011/0182634 A1 7/2011 Ishigaya et al.
2011/0182638 A1 7/2011 Ishii et al.
2011/0194869 A1 8/2011 Yoshinaga et al.
2011/0194870 A1 8/2011 Hase et al.
2011/0200344 A1* 8/2011 Sato ..... G03G 15/55 399/33
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217057 A1 9/2011 Yoshinaga et al.
2011/0217095 A1 9/2011 Ishii et al.
2011/0222875 A1 9/2011 Imada et al.
2011/0222888 A1 9/2011 Ikebuchi et al.
2011/0222929 A1 9/2011 Fujimoto et al.
2011/0222930 A1 9/2011 Fujimoto et al.
2011/0222931 A1 9/2011 Shinshi et al.
2011/0229180 A1 9/2011 Saito
2011/0229181 A1 9/2011 Iwaya et al.
2011/0274473 A1 11/2011 Shinshi et al.
2011/0299899 A1 12/2011 Ishigaya et al.
2012/0045226 A1 2/2012 Hase et al.
2012/0051774 A1 3/2012 Ikebuchi et al.
2012/0093531 A1 4/2012 Yuasa et al.
2012/0093532 A1 4/2012 Ishigaya et al.
2012/0093534 A1 4/2012 Waida et al.
2012/0107005 A1 5/2012 Hase et al.
2012/0114354 A1 5/2012 Saito et al.
2012/0148287 A1 6/2012 Samei et al.
2012/0148317 A1 6/2012 Samei et al.
2012/0177393 A1 7/2012 Ikebuchi et al.
2012/0177424 A1 7/2012 Saito et al.
2012/0219312 A1 8/2012 Yuasa et al.
2012/0224878 A1 9/2012 Ikebuchi et al.
2012/0237273 A1 9/2012 Yoshinaga et al.
2012/0243895 A1 9/2012 Samei et al.
2013/0051876 A1 2/2013 Ishigaya et al.
2013/0136479 A1 5/2013 Yuasa et al.
2013/0170879 A1 7/2013 Yoshinaga et al.
2013/0183071 A1 7/2013 Iwaya et al.
2013/0183072 A1 7/2013 Hase et al.
2013/0189005 A1 7/2013 Saito et al.
2013/0195477 A1 8/2013 Seshita et al.
2013/0195493 A1 8/2013 Hase et al.
2013/0195524 A1 8/2013 Ishii et al.
2013/0202320 A1 8/2013 Hase et al.
2013/0202322 A1 8/2013 Waida et al.
2013/0209115 A1 8/2013 Hase et al.
2013/0209119 A1 8/2013 Yuasa et al.
2013/0209120 A1 8/2013 Namekata et al.
2013/0209121 A1 8/2013 Uchitani et al.
2013/0209124 A1 8/2013 Saito et al.
2013/0209125 A1 8/2013 Uchitani et al.
2013/0209128 A1 8/2013 Saito et al.
2013/0209131 A1 8/2013 Uchitani et al.
2013/0251390 A1 9/2013 Ishii et al.
2014/0016972 A1 1/2014 Seshita et al.
2014/0079424 A1 3/2014 Ikebuchi et al.
2014/0133879 A1 5/2014 Seshita et al.
2014/0270820 A1 9/2014 Saito et al.
2014/0270831 A1 9/2014 Yoshinaga et al.
2014/0270832 A1 9/2014 Saito et al.
2014/0270833 A1 9/2014 Yuasa et al.
2015/0160591 A1 6/2015 Hase et al.
2015/0185671 A1 7/2015 Ikebuchi et al.
2015/0205241 A1 7/2015 Yamashina et al.
2015/0261149 A1 9/2015 Seshita et al.
2015/0261161 A1 9/2015 Waida et al.

FOREIGN PATENT DOCUMENTS

JP 2001-034109 2/2001
JP 2004286930 A * 10/2004
JP 2006-201257 8/2006
JP 2007-233011 9/2007
JP 2008-077039 4/2008
JP 2012-042760 3/2012
JP 2013-164474 8/2013

* cited by examiner

IMAGE FORMING APPARATUS AND IMAGE FORMING METHOD

CROSS-REFERENCE TO RELATED APPLICATION

This patent application is based on and claims priority pursuant to 35 U.S.C. §119 to Japanese Patent Application No. 2014-222641, filed on Oct. 31, 2014, in the Japanese Patent Office, the entire disclosure of which is hereby incorporated by reference herein.

BACKGROUND

Technical Field

Exemplary aspects of the present disclosure relate to an image forming apparatus and an image forming method, and more particularly, to an image forming apparatus for forming a toner image on a recording medium and an image forming method for forming a toner image on a recording medium.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved image forming apparatus. In one exemplary embodiment, the image forming apparatus includes a fixing rotator rotatable in a predetermined direction of rotation and an opposed rotator pressed against the fixing rotator to form a fixing nip therebetween, through which a recording medium bearing a toner image is conveyed. A heater heats the fixing rotator. A temperature sensor contacts the opposed rotator to detect a temperature of the opposed rotator. A conveyor conveys the recording medium to the fixing nip. A driver drives the conveyor. A controller, operatively connected to the temperature sensor and the driver, controls the driver to drive the conveyor to convey the recording medium to the fixing nip based on the temperature of the opposed rotator detected by the temperature sensor. The controller causes the driver to be ready to drive the conveyor when a change in the detected temperature of the opposed rotator per unit time reaches a predetermined threshold.

This specification further describes an improved image forming method. In one exemplary embodiment, the image forming method includes detecting a temperature change per second in a temperature of a pressure rotator detected by a temperature sensor; determining that the temperature change per second is 1 degree centigrade per second or smaller for three times consecutively; calculating a difference between the temperature of the pressure rotator detected by the temperature sensor and a reference temperature; storing the difference in a memory; and adding the stored difference to the detected temperature of the pressure rotator.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
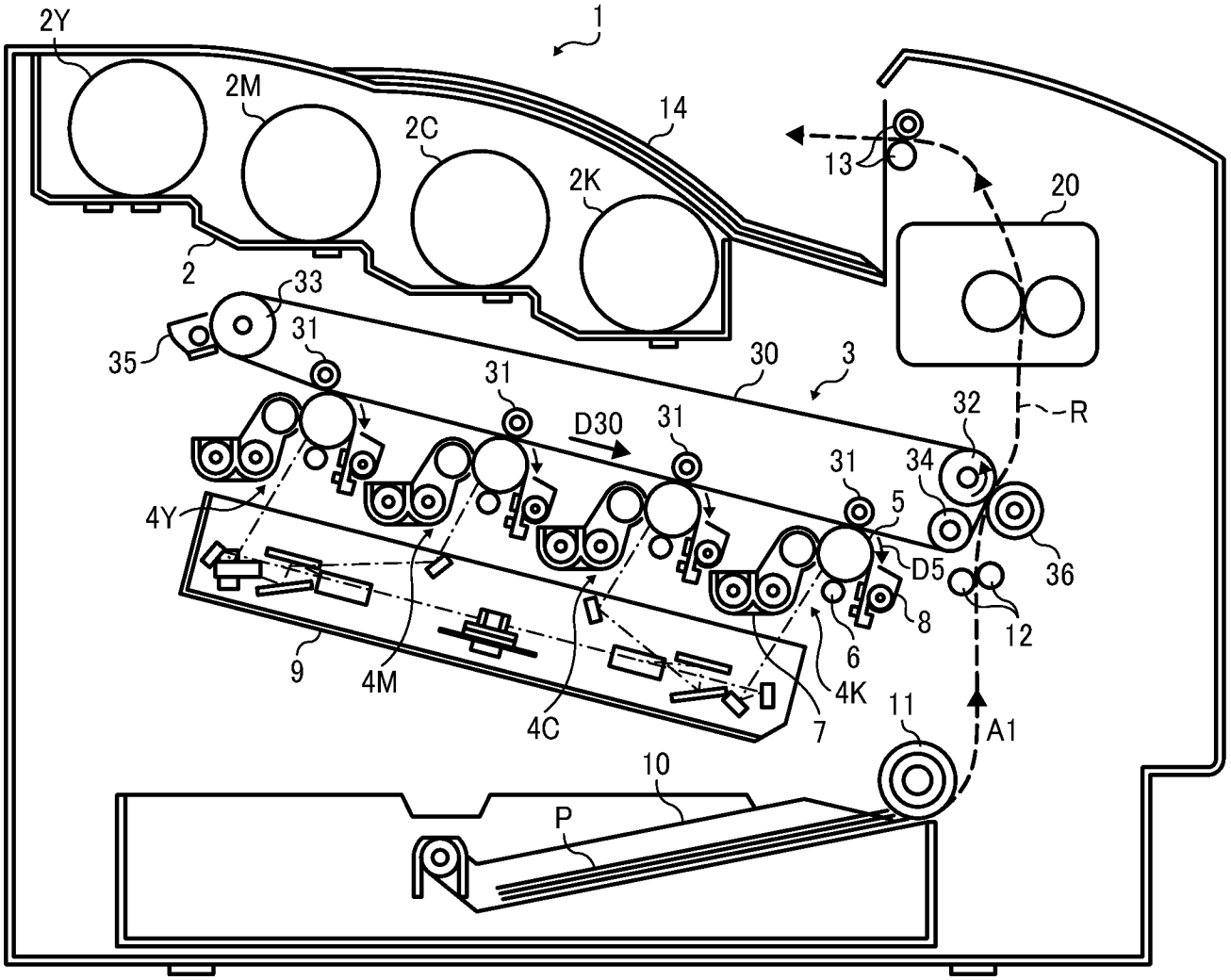
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography. Alternatively, the image forming apparatus 1 may be a monochrome printer that forms a monochrome toner image on a recording medium.

With reference to FIG. 1, a description is provided of a construction of the image forming apparatus 1.

As shown in FIG. 1, the image forming apparatus 1 includes four image forming devices 4Y, 4M, 4C, and 4K situated in a center portion thereof. Although the image forming devices 4Y, 4M, 4C, and 4K contain developers in different colors, that is, yellow, magenta, cyan, and black corresponding to color separation components of a color image, (e.g., yellow, magenta, cyan, and black toners), respectively, they have an identical structure.

For example, each of the image forming devices 4Y, 4M, 4C, and 4K includes a drum-shaped photoconductor 5 serving as an image bearer or a latent image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are connected to a power supply that applies a predetermined direct current (DC) voltage and/or alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current (DC) voltage and/or alternating current (AC) voltage thereto.

The belt cleaner 35 includes a cleaning brush and a cleaning blade that contact an outer circumferential surface of the intermediate transfer belt 30. A waste toner drain tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media. The paper tray 10 is provided with a feed roller 11 serving as a conveyor driven by a driver to pick up and feed a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction A1. The registration roller pair 12 serving as a conveyor conveys the sheet P conveyed from the feed roller 11 toward the secondary transfer nip.

The conveyance path R is further provided with a fixing device 20 (e.g., a fuser or a fusing unit) located above the secondary transfer nip, that is, downstream from the secondary transfer nip in the sheet conveyance direction A1. The fixing device 20 fixes a toner image transferred from the intermediate transfer belt 30 onto the sheet P conveyed from the secondary transfer nip. The conveyance path R is further provided with the output roller pair 13 located above the fixing device 20, that is, downstream from the fixing device 20 in the sheet conveyance direction A1. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

With reference to FIG. 1, a description is provided of an image forming operation performed by the image forming apparatus 1 having the construction described above to form a color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at each of the primary transfer nips formed between the photoconductors 5 and the primary transfer rollers 31, respectively.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 through the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

As the yellow, magenta, cyan, and black toner images constituting the color toner image on the intermediate transfer belt 30 reach the secondary transfer nip in accordance with rotation of the intermediate transfer belt 30, the transfer electric field created at the secondary transfer nip secondarily transfers the yellow, magenta, cyan, and black toner images from the intermediate transfer belt 30 onto the sheet P collectively. After the secondary transfer of the color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container.

Thereafter, the sheet P bearing the color toner image is conveyed to the fixing device 20 that fixes the color toner image on the sheet P. Then, the sheet P bearing the fixed color toner image is ejected by the output roller pair 13 onto the outside of the image forming apparatus 1, that is, the output tray 14 that stocks the sheet P.

The above describes the image forming operation of the image forming apparatus 1 to form the color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
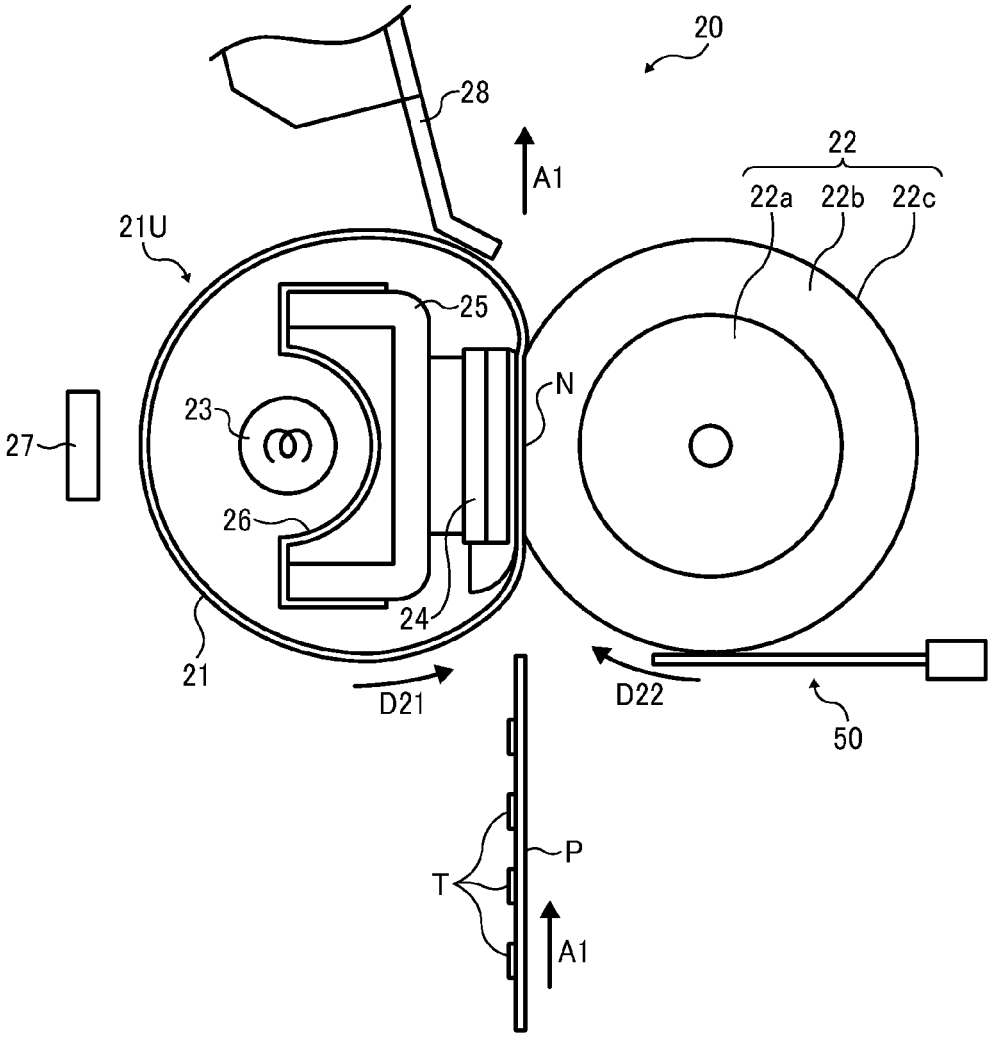
FIG. 2 is a schematic vertical sectional view of a fixing device installed in the image forming apparatus shown in FIG. 1.

With reference to FIG. 2, a description is provided of a construction of the fixing device 20 incorporated in the image forming apparatus 1 described above.

FIG. 2 is a schematic vertical sectional view of the fixing device 20. The fixing device 20 includes a fixing belt 21 serving as a fixing rotator or a fixing member and a pressure roller 22 serving as an opposed rotator or a pressure rotator. Inside a loop formed by the fixing belt 21 are a nip formation pad 24, a fixing stay 25, a halogen heater 23, a heat shield 26, and a pair of flanges that supports the nip formation pad 24, the fixing stay 25, the halogen heater 23, and the heat shield 26. The pressure roller 22 is pressed against the nip formation pad 24 via the fixing belt 21 to form a fixing nip N between the pressure roller 22 and the fixing belt 21. The fixing stay 25 supports the nip formation pad 24 against load or pressure exerted from the pressure roller 22 to the nip formation pad 24. The halogen heater 23 serves as a heater or a heat source for heating the fixing belt 21. The fixing belt 21 and the components situated inside the loop formed by the fixing belt 21, that is, the nip formation pad 24, the fixing stay 25, the halogen heater 23, and the heat shield 26, may constitute a belt unit 21U detachably attached to the fixing device 20. As shown in FIG. 2, the fixing nip N is planar. Alternatively, the fixing nip N may be contoured into a recess, a curve, or other shapes. If the fixing nip N defines a recess or a curve, the curved fixing nip N directs a leading edge of the sheet P toward the pressure roller 22 as the sheet P is ejected from the fixing nip N, facilitating separation of the sheet P from the fixing belt 21 and suppressing jamming of the sheet P.

A detailed description is now given of a construction of the pressure roller 22.

The pressure roller 22 is constructed of a metal roller 22*a*, an elastic layer 22*b* coating an outer circumferential surface of the metal roller 22*a* and being made of silicone rubber, and a release layer 22*c* coating an outer circumferential surface of the elastic layer 22*b*. The release layer 22*c* is made of tetrafluoroethylene-perfluoroalkylvinylether copolymer (PFA), polytetrafluoroethylene (PTFE), or the like to facilitate separation of the sheet P from the pressure roller 22. As a driving force generated by a driver (e.g., a motor) situated inside the image forming apparatus 1 depicted in FIG. 1 is transmitted to the pressure roller 22 through a gear train, the pressure roller 22 rotates in a rotation direction D22.

A spring or the like presses the pressure roller 22 against the nip formation pad 24 via the fixing belt 21. As the spring presses and deforms the elastic layer 22*b* of the pressure roller 22, the pressure roller 22 produces the fixing nip N having a predetermined length in the sheet conveyance direction A1. Alternatively, the pressure roller 22 may be a solid roller. However, a hollow roller has a decreased thermal capacity. Further, a heater such as a halogen heater may be disposed inside the pressure roller 22.

The elastic layer 22*b* may be made of solid rubber. Alternatively, if no heater is situated inside the pressure roller 22, the elastic layer 22*b* may be made of sponge rubber. The sponge rubber is more preferable than the solid rubber because it has an increased insulation that draws less heat from the fixing belt 21.

A detailed description is now given of a construction of the fixing belt 21.

The fixing belt 21 is an endless belt or film rotatable in a rotation direction D21 and made of metal such as nickel and SUS stainless steel or resin such as polyimide. The fixing belt 21 is constructed of a base layer and a release layer. The release layer constituting an outer surface layer is made of PFA, PTFE, or the like to facilitate separation of toner of a toner image T on the sheet P from the fixing belt 21. An elastic layer may be sandwiched between the base layer and the release layer and made of silicone rubber or the like. If the fixing belt 21 does not incorporate the elastic layer, the fixing belt 21 has a decreased thermal capacity that improves a fixing property of being heated quickly. However, as the pressure roller 22 and the fixing belt 21 sandwich and press the toner image T on the sheet P passing through the fixing nip N, slight surface asperities of the fixing belt 21 may be transferred onto the toner image T on the sheet P, producing an orange peel mark on the solid toner image T on the sheet P. To address this circumstance, the elastic layer of the fixing belt 21 has a thickness not smaller than 100 micrometers. As the elastic layer deforms, the elastic layer absorbs slight surface asperities of the fixing belt 21, preventing formation of a faulty orange peel image.

A detailed description is now given of a configuration of other components of the fixing device 20.

The heat shield 26 interposed between the halogen heater 23 and the fixing stay 25 shields the fixing stay 25 from heat or light radiated from the halogen heater 23, preventing the fixing stay 25 from being heated by the halogen heater 23 and thereby reducing waste of energy. Alternatively, instead of the heat shield 26, an opposed face of the fixing stay 25 disposed opposite the halogen heater 23 may be treated with insulation or mirror finish.

Alternatively, the heater for heating the fixing belt 21 may be an induction heating (IH) coil, a resistance heat generator, a carbon heater, or the like, instead of the halogen heater 23. As the driver drives and rotates the pressure roller 22, the driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21. A separator 28 disposed downstream from the fixing nip N in the sheet conveyance direction A1 separates the sheet P ejected from the fixing nip N from the fixing belt 21. A temperature sensor 27 disposed opposite the fixing belt 21 detects the temperature of the fixing belt 21.

Figure 3:
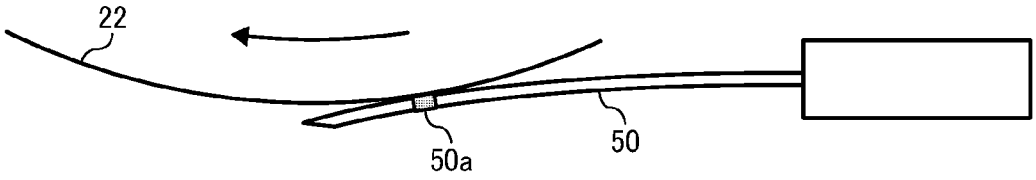
FIG. 3 is a sectional view of a temperature sensor incorporated in the fixing device shown in FIG. 2.

A temperature sensor 50 serving as a temperature detector contacts the pressure roller 22 to detect the temperature of the pressure roller 22. FIG. 3 is a sectional view of the temperature sensor 50. As shown in FIG. 3, the temperature sensor 50 includes a detection element 50*a* contacting the pressure roller 22.

A description is provided of a control performed by the image forming apparatus 1.

Figure 4:
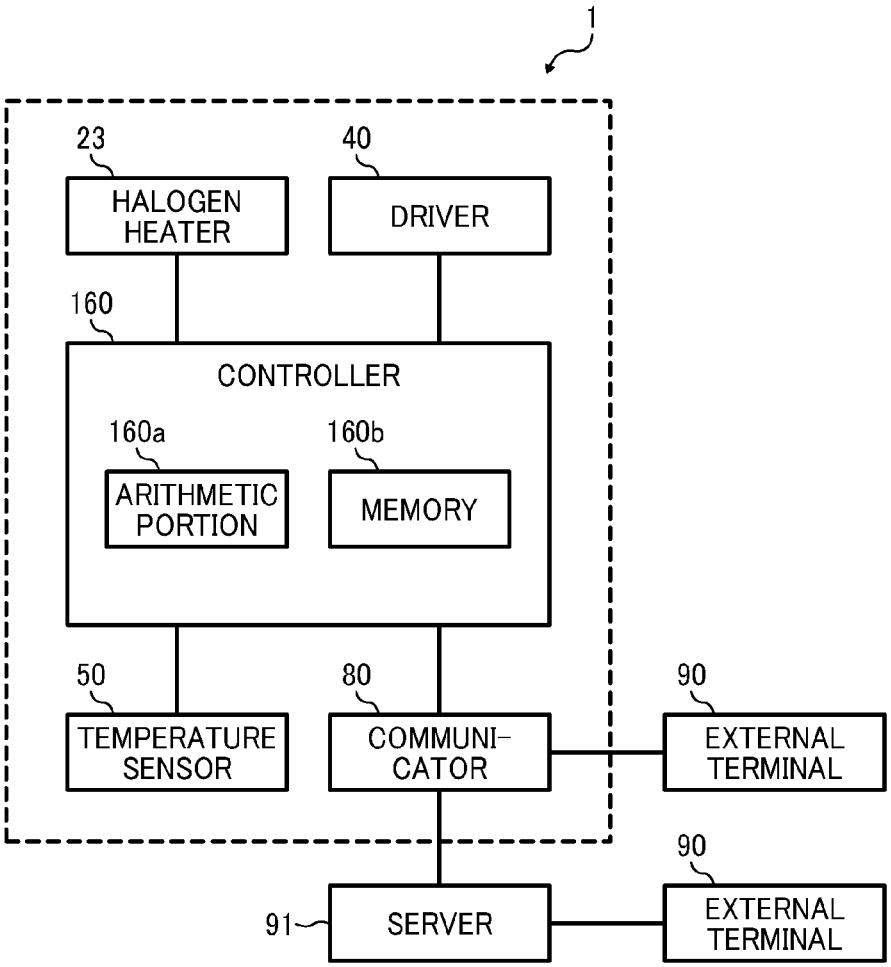
FIG. 4 is a block diagram of the image forming apparatus shown in FIG. 1 illustrating a controller incorporated therein.

FIG. 4 is a block diagram of the image forming apparatus 1. As shown in FIG. 4, the image forming apparatus 1 further includes a driver 40, a communicator 80, and a controller 160. The halogen heater 23 and the temperature sensor 50 are connected to the controller 160.

The driver 40 drives components that convey the sheet P, that is, conveyors, such as the feed roller 11 and the registration roller pair 12 depicted in FIG. 1. The communicator 80 receives information such as image data from an external terminal 90 such as a client computer through a network or the like. Alternatively, the communicator 80 may receive information such as image data from another external terminal 90 such as a client computer through a server 91. Upon receipt of the information, the communicator 80 sends the information to the controller 160.

The temperature sensor 50 detects the temperature of an outer circumferential surface of the pressure roller 22. The temperature sensor 50 sends the detected temperature of the pressure roller 22 to the controller 160.

The controller 160 includes an arithmetic portion 160*a* and a memory 160*b*. The arithmetic portion 160*a* calculates a difference between a current temperature and a reference temperature as described below. The memory 160*b* stores the difference calculated by the arithmetic portion 160*a*.

The controller 160 controls at least one of driving of the driver 40 and an amount of power supplied to the halogen heater 23 based on information sent from the communicator 80, the temperature sensor 50, and the memory 160*b*.

The temperature to allow feeding or conveyance of the sheet P, that is, the reference temperature, varies depending on the type and the thickness of the sheet P. Accordingly, in order to allow the driver 40 to drive the conveyor to convey the sheet P based on the temperature of the pressure roller 22 detected by the temperature sensor 50, it is necessary to detect the temperature of the pressure roller 22 precisely.

Figure 5:
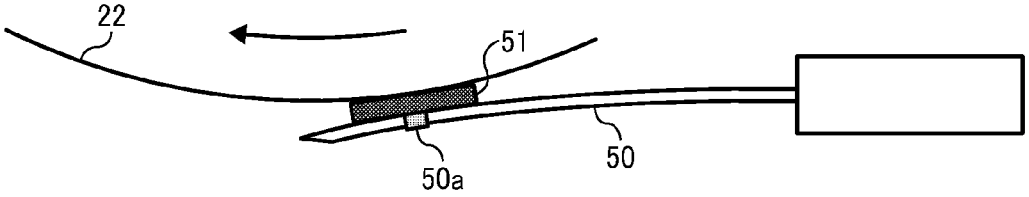
FIG. 5 is a sectional view of the temperature sensor and a pressure roller incorporated in the fixing device shown in FIG. 2 illustrating a foreign substance sandwiched therebetween.

However, if the temperature sensor 50 is not positioned relative to a detection object, that is, the pressure roller 22, precisely, or if a foreign substance 51 such as toner and paper dust adhered to the pressure roller 22 is accumulated between the pressure roller 22 and the temperature sensor 50 as shown in FIG. 5, the temperature sensor 50 may not detect the temperature of the pressure roller 22 precisely. FIG. 5 is a sectional view of the temperature sensor 50 and the pressure roller 22 illustrating the foreign substance 51.

Figure 6:
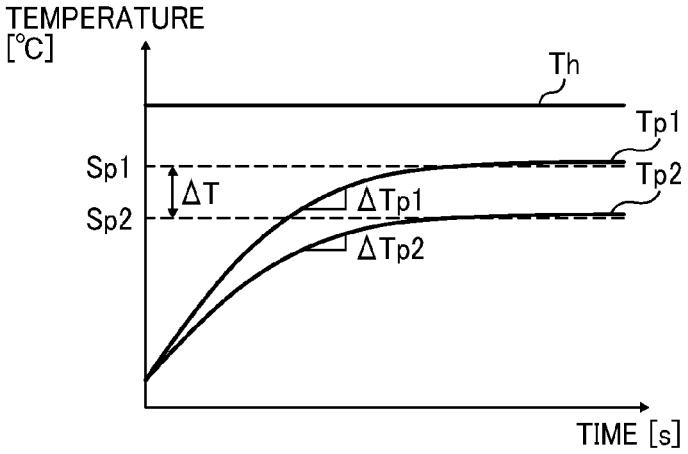
FIG. 6 is a graph showing a relation between the time and the temperature of the pressure roller detected by the temperature sensor shown in FIG. 3.

FIG. 6 is a graph showing a relation between the time and the temperature of the pressure roller 22. If the temperature sensor 50 does not detect the temperature of the pressure roller 22 precisely, the temperature sensor 50 detects an abnormal temperature Tp2 with detection error that is lower than a normal temperature Tp1 without detection error as shown in FIG. 6. In the graph shown in FIG. 6, Th represents a control temperature of the fixing belt 21 and ΔTp1 represents a temperature change per second in the normal temperature Tp1 of the pressure roller 22 detected by the temperature sensor 50 without detection error.

Accordingly, if the controller 160 is configured to allow feeding or conveyance of the sheet P when the controller 160 determines that the fixing belt 21 has stored a sufficient amount of heat based on the temperature of the pressure roller 22 detected by the temperature sensor 50, the controller 160 may delay start of printing and therefore may increase a waiting time for a user to wait for start of printing.

A description is provided of a configuration of a comparative fixing device.

The comparative fixing device includes an endless fixing belt that is heated quickly. However, if a power supply having a decreased voltage output is configured to supply power to the comparative fixing device, a heater incorporated in the comparative fixing device may receive a decreased amount of power from the power supply when peripherals of the comparative fixing device consume an increased amount of power. Accordingly, the fixing belt may suffer from shortage of heat from the heater and therefore the temperature of the fixing belt may decrease. Consequently, the fixing belt may not be heated to a desired temperature.

Additionally, a small sheet is conveyed over a center of the fixing belt in an axial direction thereof. Accordingly, after a plurality of small sheets is conveyed over the fixing belt continuously, both lateral ends of the fixing belt outboard from the center of the fixing belt in the axial direction thereof may overheat because the plurality of small sheets is not conveyed over both lateral ends of the fixing belt and therefore does not draw heat therefrom. Consequently, the overheated fixing belt may be damaged or broken.

In order to prevent overheating of both lateral ends of the fixing belt, a controller may control the heater based on a temperature of a pressure roller detected by a contact temperature sensor contacting the pressure roller.

However, the contact temperature sensor may include a downsized detection element to improve responsiveness. Hence, the contact temperature sensor may suffer from shifting from the pressure roller or releasing of pressure, resulting in detection error. If the temperature sensor detects the temperature of the pressure roller with detection error, the controller may delay control of the heater based on the detected temperature of the pressure roller, increasing the waiting time for the user to wait for start of printing. Further, the controller may cause the heater to overheat the fixing belt, resulting in damage and breakage of the fixing belt.

To address those circumstances, the controller 160 depicted in FIG. 4 performs controls described below.

A description is provided of various exemplary controls performed by the controller 160 to determine storage of heat in the fixing belt 21 based on output of the temperature sensor 50 that detects the temperature of the pressure roller 22.

At least two exemplary controls described below may be combined within an applicable range. Each of flowcharts shown in FIGS. 7 to 11 and 13 is an example of a routine control performed by the controller 160. Hence, other flowcharts may also be applicable within a scope of the present disclosure to achieve advantages thereof.

Figure 7:
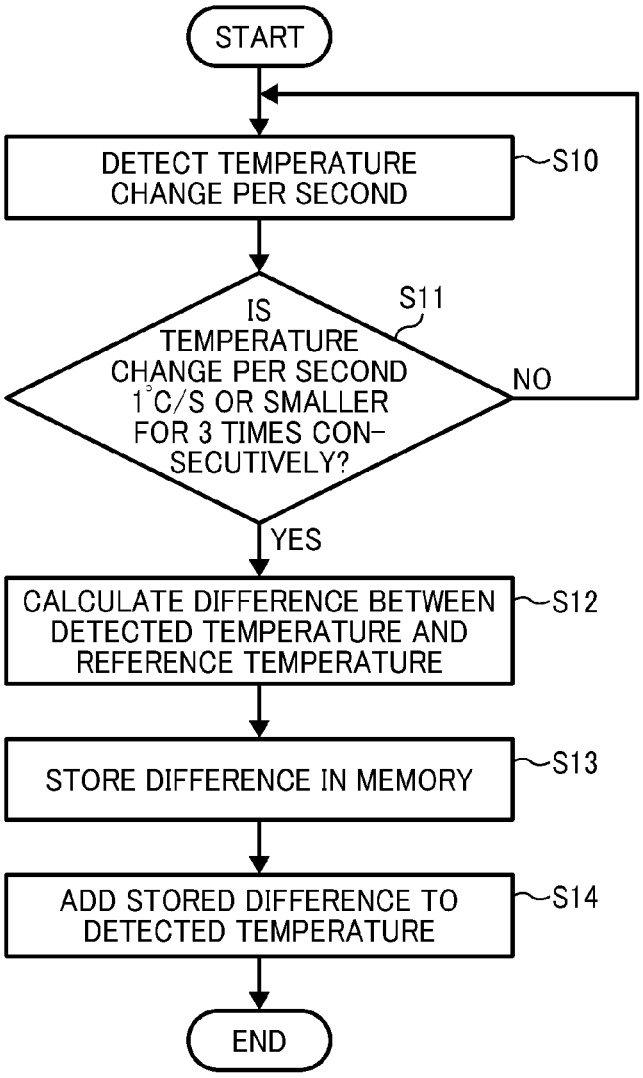
FIG. 7 is a flowchart showing control processes of a first exemplary control performed by the controller shown in FIG. 4.

With reference to FIG. 7, a description is provided of a first exemplary control performed by the controller 160.

FIG. 7 is a flowchart showing control processes of the first exemplary control.

If the temperature sensor 50 detects the abnormal temperature Tp2 of the pressure roller 22 with detection error as shown in FIG. 6, the controller 160 detects a temperature change ΔTp2 per second in the temperature of the pressure roller 22 detected by the temperature sensor 50 in step S10. The controller 160 determines whether or not the temperature change ΔTp2 per second is 1 degree centigrade or smaller per second for three times consecutively, for example, in step S11. If the controller 160 determines that the temperature change ΔTp2 per second is not 1 degree centigrade or smaller per second for three times consecutively (NO in step S11), the controller 160 returns to step S10. Conversely, if the controller 160 determines that the temperature change ΔTp2 per second is 1 degree centigrade or smaller per second for three times consecutively (YES in step S11), the arithmetic portion 160*a* of the controller 160 depicted in FIG. 4 calculates a difference ΔT between a detected temperature Sp2 of the pressure roller 22 detected by the temperature sensor 50, that is, a current temperature, and a reference temperature Sp1 defining a temperature at which the controller 160 allows the driver 40 to drive the conveyor to convey the sheet P in step S12. In step S13, the memory 160*b* of the controller 160 depicted in FIG. 4 stores the difference ΔT. In step S14, the controller 160 adds the stored difference ΔT to the detected temperature Sp2, finishing the first exemplary control. The controller 160 allows the driver 40 to drive the conveyor or causes the driver 40 to be ready to drive the conveyor based on information, that is, a value, obtained by adding the stored difference ΔT to the detected temperature Sp2. According to this exemplary embodiment, a threshold for the temperature change ΔTp2 per second is 1 degree centigrade per second. However, the threshold is not limited to 1 degree centigrade per second.

According to the first exemplary control, the controller 160 corrects the temperature of the pressure roller 22 detected by the temperature sensor 50. Accordingly, even if the temperature sensor 50 does not detect the temperature of the pressure roller 22 precisely, the controller 160 prevents delay in start of printing due to control based on output from the temperature sensor 50, shortening the waiting time for the user.

Figure 8:
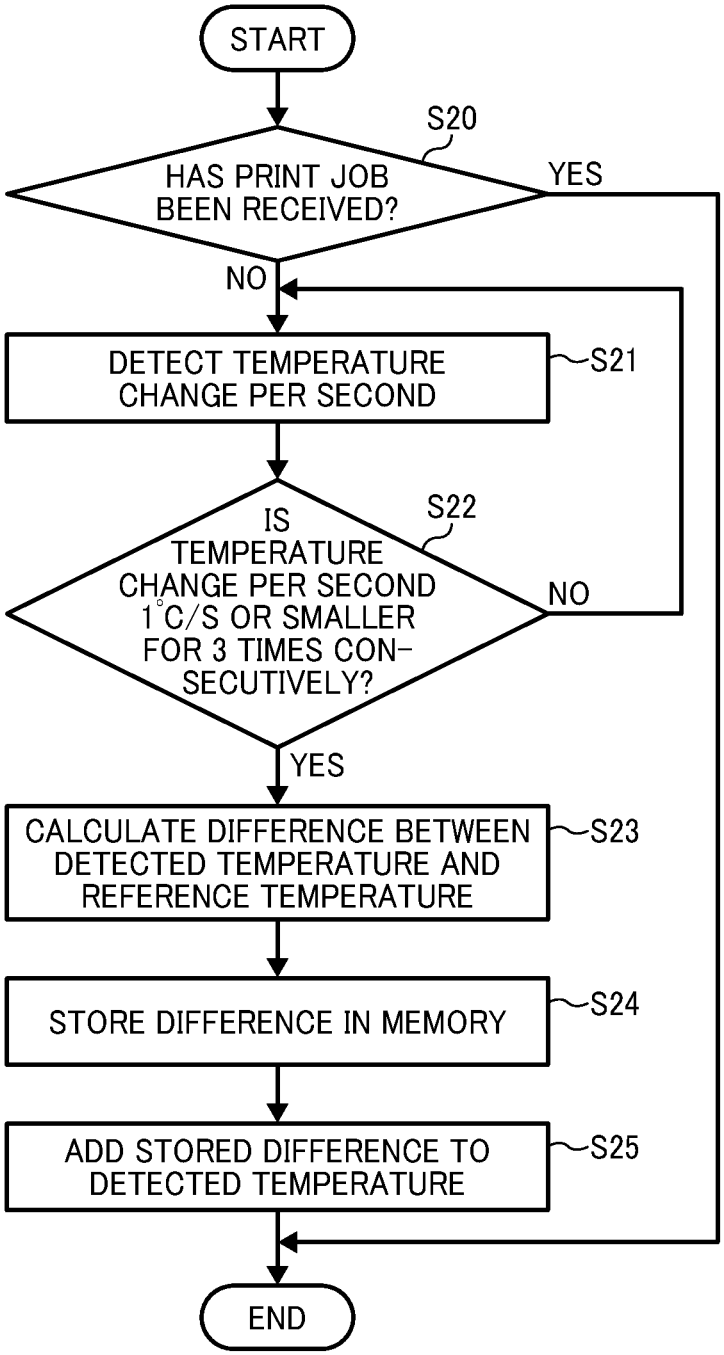
FIG. 8 is a flowchart showing control processes of a second exemplary control performed by the controller shown in FIG. 4.

With reference to FIG. 8, a description is provided of a second exemplary control performed by the controller 160.

FIG. 8 is a flowchart showing control processes of the second exemplary control.

When the fixing device 20 is driven initially, that is, when the fixing device 20 is powered on as a main power supply of the image forming apparatus 1 is turned on, for example, if the temperature sensor 50 detects the abnormal temperature Tp2 of the pressure roller 22 with detection error as shown in FIG. 6, the controller 160 starts the second exemplary control and determines whether or not the image forming apparatus 1 has received a print job in step S20. The print job defines a series of image forming processes to be performed by the image forming apparatus 1 upon receipt of an instruction from the user. If the controller 160 determines that the image forming apparatus 1 has received the print job (YES in step S20), the controller 160 finishes the second exemplary control. Conversely, if the controller 160 determines that the image forming apparatus 1 has not received the print job (NO in step S20), the controller 160 detects the temperature change ΔTp2 per second in the temperature of the pressure roller 22 detected by the temperature sensor 50 in step S21. The controller 160 determines whether or not the temperature change ΔTp2 per second is 1 degree centigrade or smaller per second for three times consecutively, for example, in step S22. If the controller 160 determines that the temperature change ΔTp2 per second is not 1 degree centigrade or smaller per second for three times consecutively (NO in step S22), the controller 160 returns to step S21. Conversely, if the controller 160 determines that the temperature change ΔTp2 per second is 1 degree centigrade or smaller per second for three times consecutively (YES in step S22), the arithmetic portion 160*a* of the controller 160 calculates the difference ΔT between the detected temperature Sp2 of the pressure roller 22 detected by the temperature sensor 50, that is, the current temperature, and the reference temperature Sp1, that is, the temperature at which the controller 160 allows the driver 40 to drive the conveyor to convey the sheet P in step S23. In step S24, the memory 160*b* of the controller 160 stores the difference ΔT. In step S25, the controller 160 adds the stored difference ΔT to the detected temperature Sp2, finishing the second exemplary control. The controller 160 allows the driver 40 to drive the conveyor or causes the driver 40 to be ready to drive the conveyor based on information, that is, a value, obtained by adding the stored difference ΔT to the detected temperature Sp2.

According to the second exemplary control, the controller 160 corrects the temperature of the pressure roller 22 detected by the temperature sensor 50. Accordingly, even if the temperature sensor 50 does not detect the temperature of the pressure roller 22 precisely, the controller 160 prevents delay in start of printing due to control based on output from the temperature sensor 50, shortening the waiting time for the user.

Figure 9:
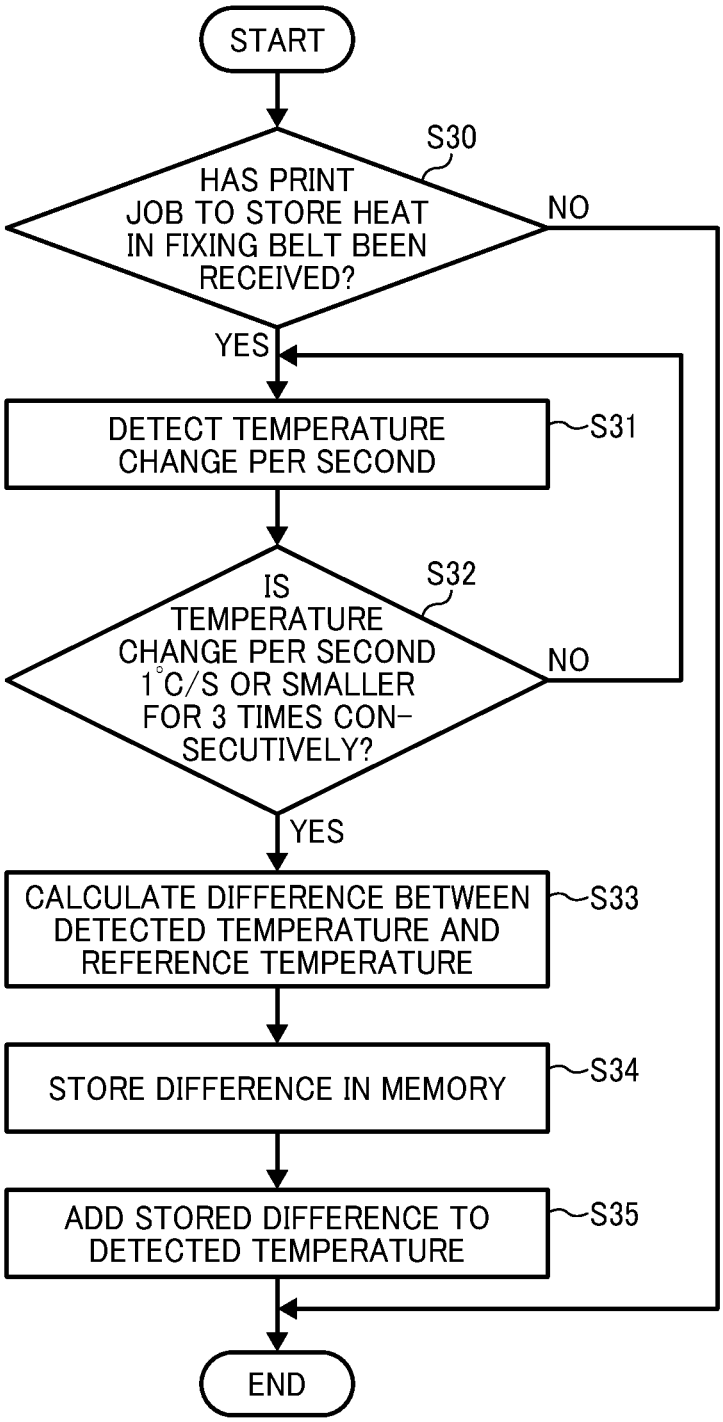
FIG. 9 is a flowchart showing control processes of a third exemplary control performed by the controller shown in FIG. 4.

With reference to FIG. 9, a description is provided of a third exemplary control performed by the controller 160.

FIG. 9 is a flowchart showing control processes of the third exemplary control.

When the fixing device 20 is driven initially, that is, when the fixing device 20 or the image forming apparatus 1 is powered on, if the temperature sensor 50 detects the abnormal temperature Tp2 of the pressure roller 22 with detection error as shown in FIG. 6, the controller 160 starts the third exemplary control and determines whether or not the image forming apparatus 1 has received a print job that requests the fixing belt 21 to store heat in step S30. The print jot that requests the fixing belt 21 to store heat (hereinafter referred to as the print job requesting heat storage) defines a print instruction or the like, for example. If the controller 160 determines that the image forming apparatus 1 has not received the print job requesting heat storage (NO in step S30), the controller 160 finishes the third exemplary control. Conversely, if the controller 160 determines that the image forming apparatus 1 has received the print job requesting heat storage (YES in step S30), the controller 160 detects the temperature change ΔTp2 per second in the temperature of the pressure roller 22 detected by the temperature sensor 50 in step S31. The controller 160 determines whether or not the temperature change ΔTp2 per second is 1 degree centigrade or smaller per second for three times consecutively, for example, in step S32. If the controller 160 determines that the temperature change ΔTp2 per second is not 1 degree centigrade or smaller per second for three times consecutively (NO in step S32), the controller 160 returns to step S31. Conversely, if the controller 160 determines that the temperature change ΔTp2 per second is 1 degree centigrade or smaller per second for three times consecutively (YES in step S32), the arithmetic portion 160*a* of the controller 160 calculates the difference ΔT between the detected temperature Sp2 of the pressure roller 22 detected by the temperature sensor 50, that is, the current temperature, and the reference temperature Sp1, that is, the temperature at which the controller 160 allows the driver 40 to drive the conveyor to convey the sheet P in step S33. In step S34, the memory 160*b* of the controller 160 stores the difference ΔT. In step S35, the controller 160 adds the stored difference ΔT to the detected temperature Sp2, finishing the third exemplary control. The controller 160 allows the driver 40 to drive the conveyor or causes the driver 40 to be ready to drive the conveyor based on information, that is, a value, obtained by adding the stored difference ΔT to the detected temperature Sp2.

According to the third exemplary control, the controller 160 corrects the temperature of the pressure roller 22 detected by the temperature sensor 50. Accordingly, even if the temperature sensor 50 does not detect the temperature of the pressure roller 22 precisely, the controller 160 prevents delay in start of printing due to control based on output from the temperature sensor 50, shortening the waiting time for the user.

Figure 10:
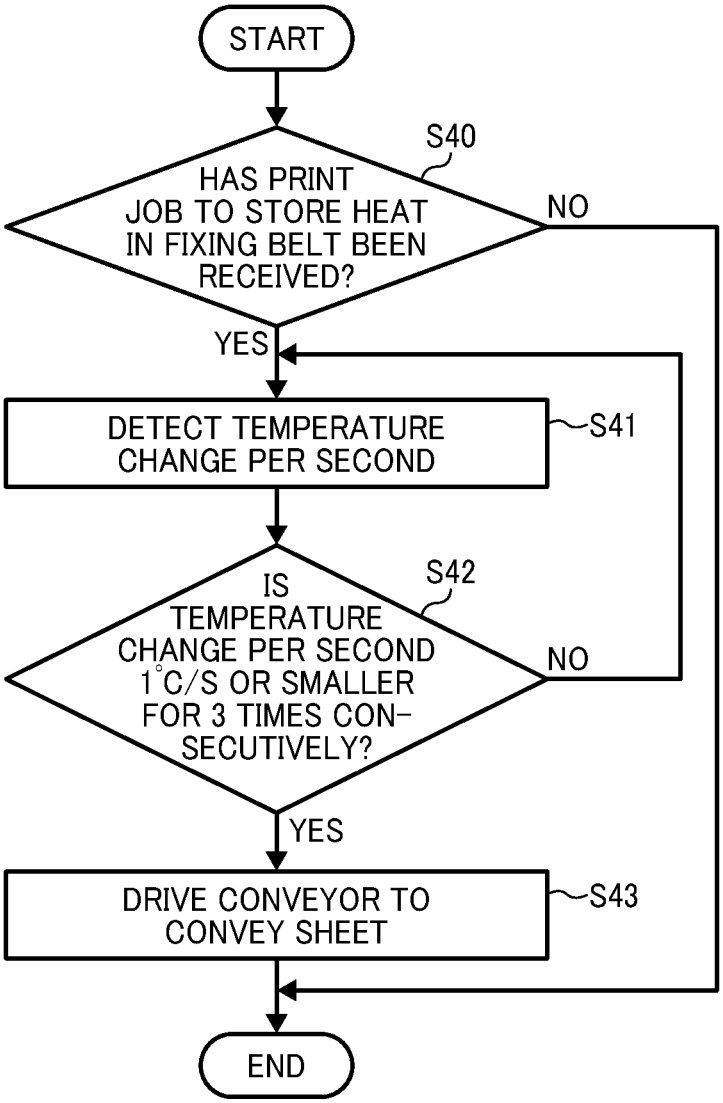
FIG. 10 is a flowchart showing control processes of a fourth exemplary control performed by the controller shown in FIG. 4.

With reference to FIG. 10, a description is provided of a fourth exemplary control performed by the controller 160.

FIG. 10 is a flowchart showing control processes of the fourth exemplary control.

When the fixing device 20 is driven initially, that is, when the fixing device 20 or the image forming apparatus 1 is powered on, if the temperature sensor 50 detects the abnormal temperature Tp2 of the pressure roller 22 with detection error as shown in FIG. 6, the controller 160 starts the fourth exemplary control and determines whether or not the image forming apparatus 1 has received a print job that requests the fixing belt 21 to store heat in step S40. The print job that requests the fixing belt 21 to store heat, that is, the print job requesting heat storage, defines a print instruction or the like, for example. If the controller 160 determines that the image forming apparatus 1 has not received the print job requesting heat storage (NO in step S40), the controller 160 finishes the fourth exemplary control. Conversely, if the controller 160 determines that the image forming apparatus 1 has received the print job requesting heat storage (YES in step S40), the controller 160 detects them temperature change ΔTp2 per second in the temperature of the pressure roller 22 detected by the temperature sensor 50 in step S41. The controller 160 determines whether or not the temperature change ΔTp2 per second is 1 degree centigrade or smaller per second for three times consecutively, for example, in step S42. If the controller 160 determines that the temperature change ΔTp2 per second is not 1 degree centigrade or smaller per second for three times consecutively (NO in step S42), the controller 160 returns to step S41. Conversely, if the controller 160 determines that the temperature change ΔTp2 per second is 1 degree centigrade or smaller per second for three times consecutively (YES in step S42), the controller 160 controls the driver 40 to drive the conveyor to convey the sheet P in step S43, thus finishing the fourth exemplary control.

According to the fourth exemplary control, the controller 160 corrects the temperature of the pressure roller 22 detected by the temperature sensor 50. Accordingly, even if the temperature sensor 50 does not detect the temperature of the pressure roller 22 precisely, the controller 160 prevents delay in start of printing due to control based on output from the temperature sensor 50, shortening the waiting time for the user.

Figure 11:
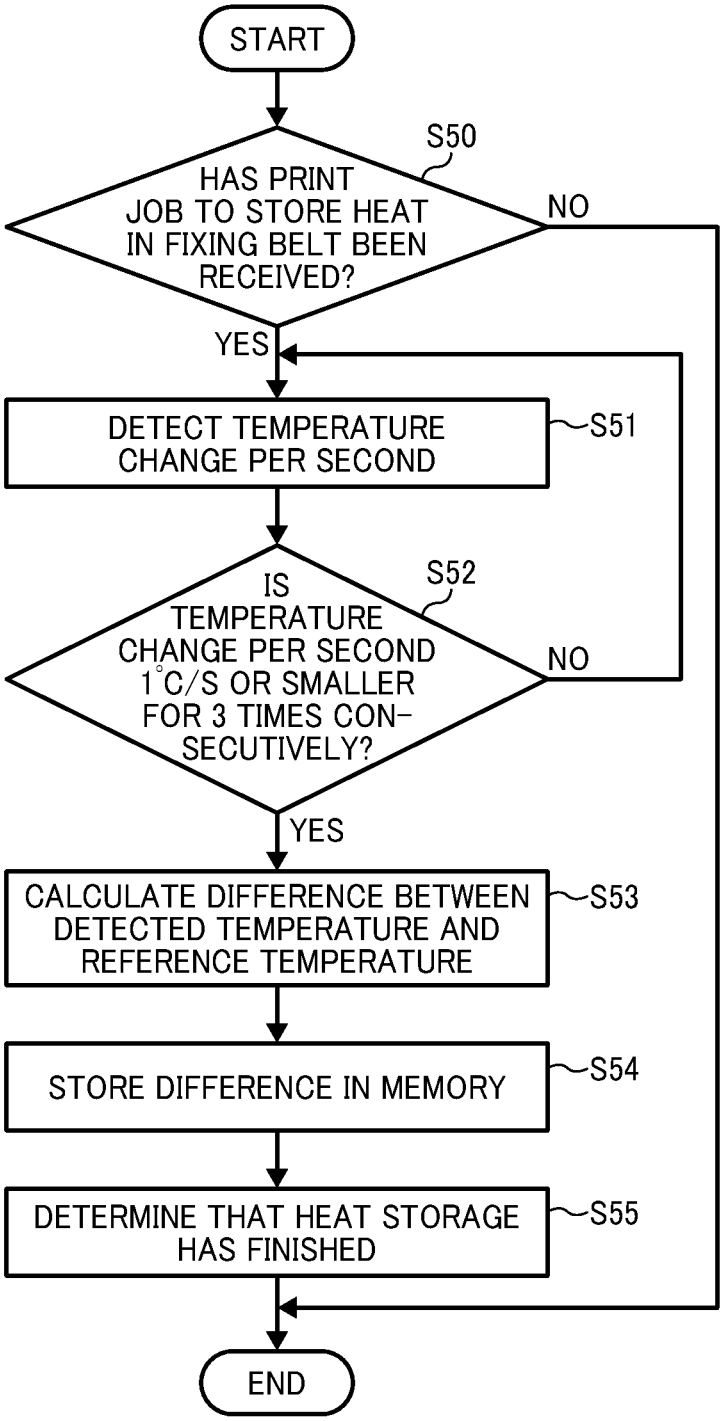
FIG. 11 is a flowchart showing control processes of a fifth exemplary control performed by the controller shown in FIG. 4.

With reference to FIG. 11, a description is provided of a fifth exemplary control performed by the controller 160.

FIG. 11 is a flowchart showing control processes of the fifth exemplary control.

When the fixing device 20 is driven initially, that is, when the fixing device 20 or the image forming apparatus 1 is powered on, if the temperature sensor 50 detects the abnormal temperature Tp2 of the pressure roller 22 with detection error as shown in FIG. 6, the controller 160 starts the fifth exemplary control and determines whether or not the image forming apparatus 1 has received a print job that requests the fixing belt 21 to store heat in step S50. The print jot that requests the fixing belt 21 to store heat, that is, the print job requesting heat storage, defines a print instruction or the like, for example. If the controller 160 determines that the image forming apparatus 1 has not received the print job requesting heat storage (NO in step S50), the controller 160 finishes the fifth exemplary control. Conversely, if the controller 160 determines that the image forming apparatus 1 has received the print job requesting heat storage (YES in step S50), the controller 160 detects the temperature change ΔTp2 per second in the temperature of the pressure roller 22 detected by the temperature sensor 50 in step S51. The controller 160 determines whether or not the temperature change ΔTp2 per second is 1 degree centigrade or smaller per second for three times consecutively, for example, in step S52. If the controller 160 determines that the temperature change ΔTp2 per second is not 1 degree centigrade or smaller per second for three times consecutively (NO in step S52), the controller 160 returns to step S51. Conversely, if the controller 160 determines that the temperature change ΔTp2 per second is 1 degree centigrade or smaller per second for three times consecutively (YES in step S52), the arithmetic portion 160*a* of the controller 160 calculates the difference ΔT between the detected temperature Sp2 of the pressure roller 22 detected by the temperature sensor 50, that is, the current temperature, and the reference temperature Sp1, that is, the temperature at which the controller 160 allows the driver 40 to drive the conveyor to convey the sheet P in step S53. In step S54, the memory 160*b* of the controller 160 stores the difference ΔT. In step S55, the controller 160 determines that the fixing belt 21 has stored heat based on a total value obtained by adding the stored difference ΔT to the detected temperature Sp2, thus finishing the fifth exemplary control.

According to the fifth exemplary control, the controller 160 corrects the temperature of the pressure roller 22 detected by the temperature sensor 50. Accordingly, even if the temperature sensor 50 does not detect the temperature of the pressure roller 22 precisely, the controller 160 prevents delay in start of printing due to control based on output from the temperature sensor 50, shortening the waiting time for the user.

A description is provided of a comparative control.

Figure 12:
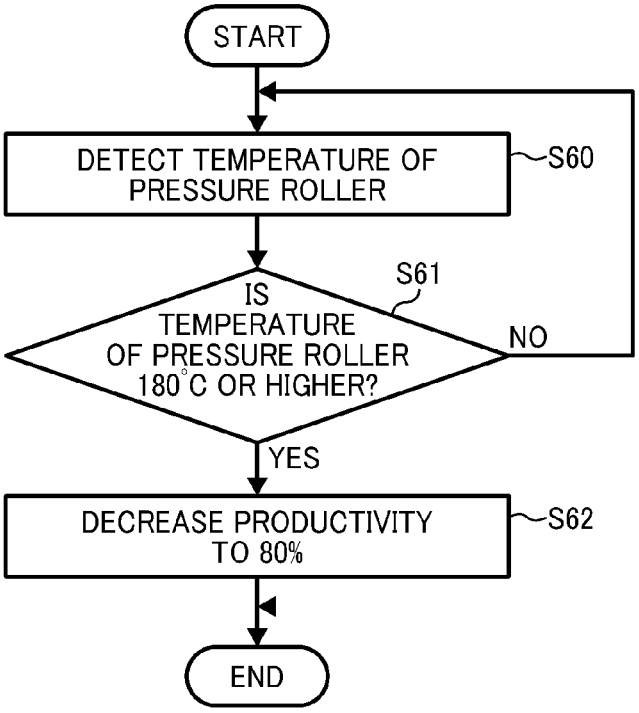
FIG. 12 is a flowchart showing a comparative control.

FIG. 12 is a flowchart showing the comparative control. In a comparative fixing device configured to control heating of a fixing belt by estimating heating of the fixing belt based on a temperature of a pressure roller detected by a temperature sensor, if the temperature of the pressure roller detected by the temperature sensor exceeds 180 degrees centigrade, for example, a controller degrades productivity of the comparative fixing device to suppress heating of the fixing belt, thus preventing damage to the fixing belt. For example, as shown in FIG. 12 illustrating the comparative control, the temperature sensor detects the temperature of an outer circumferential surface of the pressure roller in step S60. The controller determines whether or not the temperature of the pressure roller detected by the temperature sensor is a temperature at which it is necessary to suppress temperature increase of the pressure roller, for example, 180 degrees centigrade or higher, in step S61. If the controller determines that the temperature of the pressure roller detected by the temperature sensor is not 180 degrees centigrade or higher (NO in step S61), the controller returns to step S60. Conversely, if the controller determines that the temperature of the pressure roller detected by the temperature sensor is 180 degrees centigrade or higher (YES in step S61), the controller decreases productivity of printing to 80 percent of a current productivity in step S62, thus finishing the comparative control.

According to the comparative control shown in FIG. 12, even if the temperature sensor detects the temperature of the pressure roller with detection error, the comparative fixing device controls heating of the fixing belt by estimating the temperature of the fixing belt based on the temperature of the pressure roller detected by the temperature sensor. However, the controller does not detect overheating of the fixing belt precisely, resulting in damage or breakage of the fixing belt. Additionally, even if both lateral ends of the fixing belt in an axial direction thereof overheat after a plurality of sheets is conveyed over a center of the fixing belt in the axial direction thereof because the plurality of sheets is not conveyed over both lateral ends of the fixing belt and therefore does not draw heat from both lateral ends of the fixing belt, the comparative fixing device controls heating of the fixing belt by estimating the temperature of the fixing belt based on the temperature of the pressure roller detected by the temperature sensor. However, the controller does not detect overheating of the fixing belt precisely, resulting in damage or breakage of the fixing belt. To address this circumstance, the controller 160 shown in FIG. 4 performs control processes described below.

Figure 13:
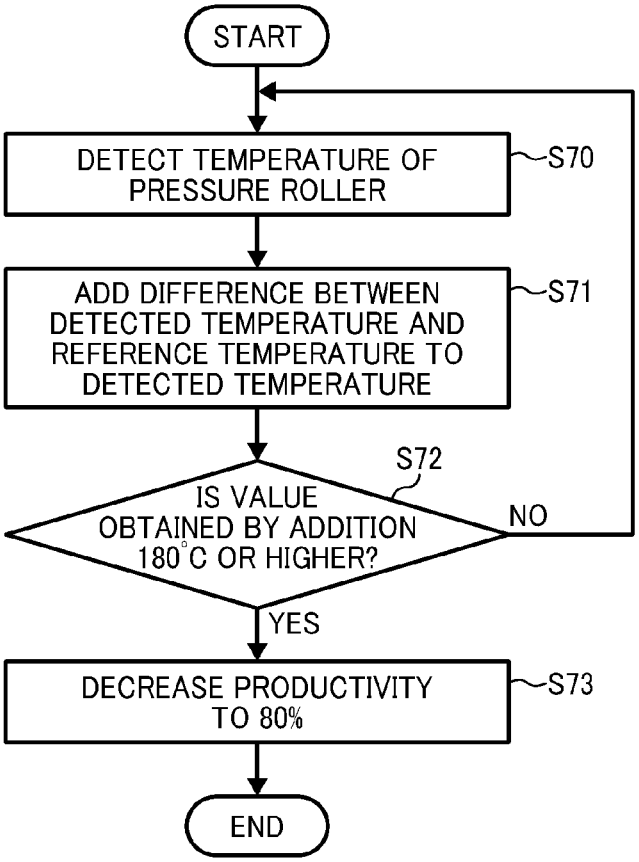
FIG. 13 is a flowchart showing control processes of a sixth exemplary control performed by the controller shown in FIG. 4.

With reference to FIG. 13, a description is provided of a sixth exemplary control performed by the controller 160.

FIG. 13 is a flowchart showing control processes of the sixth exemplary control.

If the controller 160 performs any one of the first to fifth exemplary controls, the controller 160 starts the sixth exemplary control and the temperature sensor 50 detects the temperature of the outer circumferential surface of the pressure roller 22 in step S70. In step S71, the controller 160 adds the difference ΔT stored in the memory 160*b* to the temperature of the pressure roller 22 detected by the temperature sensor 50. In step S72, the controller 160 determines whether or not a total value obtained by adding the stored difference ΔT to the detected temperature of the pressure roller 22 is a temperature at which it is necessary to suppress temperature increase of the pressure roller 22, for example, 180 degrees centigrade or higher. If the controller 160 determines that the total value is not 180 degrees centigrade or higher (NO in step S72), the controller 160 returns to step S70. Conversely, if the controller 160 determines that the total value is 180 degrees centigrade or higher (YES in step S72), the controller 160 decreases productivity of printing to 80 percent of a current productivity in step S73, thus finishing the sixth exemplary control.

According to the sixth exemplary control, the controller 160 corrects the temperature of the pressure roller 22 detected by the temperature sensor 50. Accordingly, even if the temperature sensor 50 does not detect the temperature of the pressure roller 22 precisely, the controller 160 prevents overheating of both lateral ends of the fixing belt 21 in an axial direction thereof, thus preventing damage and breakage of the fixing belt 21.

The construction and configuration of the fixing device 20 are not limited to those of the exemplary embodiments described above. The material and dimension of each of the components described above are examples and therefore various materials and dimensions thereof may be selectively used. For example, the fixing device 20 shown in FIG. 2 employs a center conveyance method in which the sheet P is conveyed over a center of the fixing belt 21 in the axial direction thereof. Alternatively, the fixing device 20 may employ a lateral end conveyance method in which the sheet P is conveyed along one lateral edge of the fixing belt 21 in the axial direction thereof. The exemplary embodiments described above are also applicable to the fixing device 20 employing the lateral end conveyance method.

A description is provided of advantages of the fixing device 20.

As shown in FIG. 2, the fixing device 20 includes a fixing rotator (e.g., the fixing belt 21) rotatable in a predetermined direction of rotation and a nip formation pad (e.g., the nip formation pad 24) disposed inside the fixing rotator. An opposed rotator (e.g., the pressure roller 22) is pressed against the nip formation pad via the fixing rotator to form the fixing nip N between the fixing rotator and the opposed rotator. A heater (e.g., the halogen heater 23) heats the fixing rotator directly in a circumferential span on the fixing rotator other than the fixing nip N. As a recording medium (e.g., a sheet P) bearing an unfixed toner image (e.g., a toner image T) is conveyed through the fixing nip N, the toner image is fixed on the recording medium. A temperature detector (e.g., the temperature sensor 50) contacting the opposed rotator detects a temperature of the opposed rotator. As shown in FIGS. 1 and 4, a controller (e.g., the controller 160) is operatively connected to the temperature detector and a driver (e.g., the driver 40) to control the driver to drive a conveyor (e.g., the feed roller 11 and the registration roller pair 12) to convey the recording medium to the fixing nip N based on the temperature of the opposed rotator detected by the temperature detector. The controller allows the driver to drive the conveyor or causes the driver to be ready to drive the conveyor when change in the detected temperature of the opposed rotator per unit time reaches a predetermined threshold.

The controller controls the driver to drive the conveyor based on output of the temperature detector contacting the opposed rotator. Accordingly, the fixing device 20 prevents increase in the waiting time for the user to wait for start of printing and overheating of the fixing rotator due to detection error by the temperature detector.

According to the exemplary embodiments described above, the fixing belt 21 serves as a fixing rotator. Alternatively, a fixing roller, a fixing film, a fixing sleeve, or the like may be used as a fixing rotator. Further, the pressure roller 22 serves as an opposed rotator. Alternatively, a pressure belt or the like may be used as an opposed rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. An image forming apparatus comprising:

a fixing rotator rotatable in a predetermined direction of rotation;

an opposed rotator pressed against the fixing rotator to form a fixing nip therebetween, through which a recording medium bearing a toner image is conveyed;

a heater inside the fixing rotator to heat the fixing rotator;

a temperature sensor contacting the opposed rotator to detect a temperature of the opposed rotator;

a conveyor to convey the recording medium to the fixing nip;

a driver to drive the conveyor; and a controller operatively connected to the temperature sensor and the driver;

the controller controls the driver to drive the conveyor to convey the recording medium to the fixing nip or delays conveyance of the recording medium based on the temperature of the opposed rotator detected by the temperature sensor;

the controller detects a change in the detected temperature of the opposed rotator per unit time, and determines whether the change in the detected temperature reaches a predetermined threshold;

when the controller determines that the change in the detected temperature is equal to or less than the predetermined threshold, the controller calculates a difference between the detected temperature of the opposed rotator and a reference temperature defining a temperature at which the controller allows the driver to drive the conveyor to convey the recording medium, and adds the difference to the detected temperature of the opposed rotator to obtain a corrected detected temperature of the opposed rotator;

the controller allows the driver to drive the conveyor or causes the driver to be ready to drive the conveyor based on the corrected detected temperature.

2. The image forming apparatus according to claim 1, wherein the controller causes the driver to be ready to drive the conveyor when the change in the detected temperature of the opposed rotator per unit time reaches the predetermined threshold if the controller receives no print job as the image forming apparatus is powered on.

3. The image forming apparatus according to claim 1, wherein the controller causes the driver to be ready to drive the conveyor when the change in the detected temperature of the opposed rotator per unit time reaches the predetermined threshold if the controller receives a print job to store heat in the fixing rotator as the image forming apparatus is powered on.

4. The image forming apparatus according to claim 1, wherein the controller drives the driver to drive the conveyor when the change in the detected temperature of the opposed rotator per unit time reaches the predetermined threshold if the controller receives a print job to store heat in the fixing rotator as the image forming apparatus is powered on.

5. The image forming apparatus according to claim 1, wherein the reference temperature varies depending on a thickness of the recording medium.

6. The image forming apparatus according to claim 1, wherein the reference temperature varies depending on a type of the recording medium.

7. The image forming apparatus according to claim 1, wherein the controller controls an amount of power supplied to the heater based on the corrected detected temperature.

8. The image forming apparatus according to claim 1, wherein the controller determines whether the corrected detected temperature is 180 degrees centigrade or higher, and decreases productivity of printing to a percentage of current productivity if the corrected detected temperature is 180 degrees centigrade or higher.

9. The image forming apparatus according to claim 1, wherein when the change in the detected temperature of the opposed rotator per unit time reaches the predetermined threshold if the controller receives a print job to store heat in the fixing rotator as the image forming apparatus is powered on, the controller determines that the fixing rotator has stored heat based on the corrected detected temperature.

10. The image forming apparatus according to claim 1, wherein the controller includes:

an arithmetic portion to calculate the difference between the detected temperature of the opposed rotator and the reference temperature; and a memory to store the difference.

11. The image forming apparatus according to claim 1,, wherein the controller calculates the difference between the detected temperature of the opposed rotator and the reference temperature if the controller determines that the change in the detected temperature of the opposed rotator per unit time reaches the predetermined threshold for three times consecutively.

12. The image forming apparatus according to claim 1, wherein the predetermined threshold is 1 degree centigrade per second.

13. The image forming apparatus according to claim 1, wherein the fixing rotator includes an endless fixing belt and the opposed rotator includes a pressure roller.

14. The image forming apparatus according to claim 13, further comprising a nip formation pad disposed inside a loop formed by the fixing belt, wherein the pressure roller is pressed against the nip formation pad via the fixing belt.

15. The image forming apparatus according to claim 13, wherein the heater heats the fixing belt directly in a circumferential span thereon other than the fixing nip.

16. An image forming method comprising:

detecting a temperature change per second in a temperature of a pressure rotator detected by a temperature sensor, wherein the pressure rotator is pressed against a fixing rotator to form a fixing nip therebetween through which a recording medium bearing a toner image is conveyed, and wherein a heater is implemented inside of the fixing rotator;

determining that the temperature change per second is 1 degree centigrade per second or smaller for three times consecutively;

calculating a difference between the temperature of the pressure rotator detected by the temperature sensor and a reference temperature;

storing the difference in a memory;

adding the stored difference to the temperature of the pressure rotator detected by the temperature sensor to obtain a corrected detected temperature of the opposed rotator; and driving a conveyor to convey the recording medium to the fixing nip or causing a driver to be ready to drive the conveyor based on the corrected detected temperature.

17. The image forming method according to claim 16, further comprising receiving a print job that requests heat storage in the fixing rotator before detecting the temperature change per second in the temperature of the pressure rotator.

* * * * *